US009627821B1

(12) United States Patent
I

(10) Patent No.: US 9,627,821 B1
(45) Date of Patent: Apr. 18, 2017

(54) POWER CONNECTOR HAVING A TRANSPARENT OBSERVATION PORTION TO VIEW THE STATUS OF A CONTACT LIMITING MEMBER

(71) Applicant: Atom Technology Inc., Taipei (TW)

(72) Inventor: Hsiang-Yun I, Tainan (TW)

(73) Assignee: ATOM TECHNOLOGY INC., Taipei (TW)

( * ) Notice: Subject to any disclaimer, the term of this patent is extended or adjusted under 35 U.S.C. 154(b) by 0 days.

(21) Appl. No.: 15/220,813

(22) Filed: Jul. 27, 2016

(51) Int. Cl.
*H01R 13/68* (2011.01)
*H01R 13/688* (2011.01)

(52) U.S. Cl.
CPC ..... *H01R 13/68* (2013.01); *H01R 13/688* (2013.01)

(58) Field of Classification Search
CPC .... H01R 13/68; H01R 13/684; H01R 13/688; H01R 13/7032; H01R 31/08; H01R 31/085
USPC ..... 439/620.3, 301, 507
See application file for complete search history.

(56) References Cited

U.S. PATENT DOCUMENTS 3,711,768 A * 1/1973 Frazin ..... G01R 31/026 324/507
5,694,285 A * 12/1997 Lee ..... H01T 1/14 340/650
5,859,579 A * 1/1999 Branston ..... H01H 71/14 337/116
5,949,322 A * 9/1999 Radbruch ..... H01H 37/5427 337/14
6,204,747 B1 * 3/2001 Kitchens ..... H01H 37/761 337/407
7,049,973 B2 * 5/2006 Torrez ..... H01H 85/306 340/638
9,257,798 B2 2/2016 Wang
9,325,122 B1 * 4/2016 Goyal ..... H01H 85/20
9,478,876 B1 * 10/2016 Wang ..... H01R 13/113
2003/0207619 A1 * 11/2003 Beideman ..... H01R 13/68 439/620.3
2011/0193674 A1 * 8/2011 Zauner ..... H01C 7/126 337/142

FOREIGN PATENT DOCUMENTS

TW M477079 4/2014

* cited by examiner

*Primary Examiner* — Chandrika Prasad
(74) *Attorney, Agent, or Firm* — Muncy, Geissler, Olds & Lowe, P.C.

(57) ABSTRACT

A power connector having an observation portion includes a housing, a live wire conductive member, a live wire contact plate and a neutral wire conductive member. The live wire contact plate has an elastic force to move away from the live wire conductive member. The live wire conductive member and the live wire contact plate contact with each other by a first limiting element damaged at a temperature of 80°~299° C., separating the live wire contact plate from the live wire conductive member by that elastic force. The housing includes a transparent observation portion, allowing a user to see through partial or whole part of the first limiting element, of the live wire conductive member and of the live wire contact plate, enabling the observation of whether the live wire conductive member and the live wire contact plate are limited by the first limiting element to remain contacted.

9 Claims, 7 Drawing Sheets

POWER CONNECTOR HAVING A TRANSPARENT OBSERVATION PORTION TO VIEW THE STATUS OF A CONTACT LIMITING MEMBER

BACKGROUND OF THE INVENTION a) Field of the Invention

The present invention relates to a power connector having an observation portion, and more particularly to a power connector, an safety structure inside which can be sawn through to determine whether there is an anomaly.

b) Description of the Prior Art

To prevent a circuit from current overloading, short-circuit or overheating, the circuit will be usually provided with a fuse or a breaker. When the circuit temperature is too high or the current is too large, the fuse will be melted down by high temperature or the metal spring leaves of the breaker will be ejected, which forms an open circuit to power off the circuit, thereby securing the safety in using electricity.

In order to deal with that issue, a Taiwanese Utility Model Patent No. M477079, "Overheat Failure Safety Structure and a Plug and a Socket with the Overheat Failure Safety Structure," was disclosed, wherein an overheat failure safety structure is disposed on a plug or a socket. The overheat failure safety structure includes two conductive members and a stopper. The conductive members are opened relative to each other to form an open-circuit (OFF) position or contact with each other to form a closed-path (ON) position. The stopper includes a first insulation part and a second insulation part opposite to the first insulation part, thereby defining a limiting space between the first insulation part and the second insulation part. The abovementioned two conductive members are disposed in the limiting space to be tightly clipped by the first insulation part and the second insulation part, thereby forming the ON position. The stopper is deformed and damaged under a thermal deformation temperature, which changes the abovementioned two conductive members from the ON position to the OFF position.

However, upon practically using the plug or socket of the abovementioned prior art in a utilization device, when a power outage occurs, a user will not be able to easily determine whether the power outage is due to the failure of utilization device or the activation of safety structure in the plug or socket.

Furthermore, in the embodiment as shown in FIG. 1 of a U.S. Pat. No. 9,257,798, a limiting element is used independently between the live wire conductive plate and the live wire contact portion, and another limiting element is also used independently between the neutral wire conductive plate and the neutral wire contact portion. However, that U.S. Pat. No. 9,257,798 still exists with the same issue as the abovementioned Taiwanese Utility Model Patent No. M477079. In other words, when overheating, if the limiting element is damaged, the user is not able to easily determine whether the power outage is due to the failure of utilization device or that the limiting element in the socket has been damaged, as the invention is not provided with any prompting device or observable structure.

SUMMARY OF THE INVENTION

Accordingly, the present invention discloses a power connector having an observation portion, including a housing, a live wire conductive member, a live wire contact plate and a neutral wire conductive member. The housing defines a holding space to accommodate the live wire conductive member, the live wire contact plate and the neutral wire conductive member. The live wire contact plate is provided with an elastic force enabling the live wire contact plate to move away from the live wire conductive member. The live wire conductive member and the live wire contact plate contact with each other by a first limiting element which is damaged at a temperature of 80° C.~299° C., allowing the live wire contact plate to be separated from the live wire conductive member by that elastic force. The housing is provided with a transparent observation portion, so that a see-through region can be formed on an exterior of the housing through the observation portion, allowing a user to see through the holding space. The size of the see-through region covers at a same time partial or whole part of the first limiting element, partial or whole part of the live wire conductive member, and partial or whole part of the live wire contact plate, so that the user can be aware of whether the live wire conductive member and the live wire contact plate are limited by the first limiting element to maintain contacted through the observation portion.

Furthermore, the housing is provided with an opening which connects the holding space and corresponds to partial or whole part of the first limiting element, partial or whole part of the live wire conductive member and partial or whole part of the live wire contact plate. In addition, the housing includes a transparent shield to cover the opening, thereby forming the observation portion.

Furthermore, the housing includes an inner housing portion and an outer housing portion. The inner housing portion is provided with the holding space, the opening and the transparent shield. The outer housing is formed by glue molding and encloses the inner housing portion to a peripheral edge of the transparent shield, thereby exposing the transparent shield.

Furthermore, a stair edge is disposed at the inner housing portion in adjacent to the opening; whereas the peripheral edge abuts at the stair edge and is enclosed and fixed by the outer housing portion.

Furthermore, the live wire conductive member is provided with a live wire pin, the neutral wire conductive member is provided with a neutral wire pin, and the live wire pin and the neutral wire pin are all protruded out of the housing to form a plug.

Furthermore, the live wire conductive member is provided with a live wire slot, and the neutral wire conductive member is provided with a neutral wire slot; whereas, the housing is provided with a live wire receptacle corresponding to the live wire slot and a neutral wire receptacle corresponding to the neutral wire slot, thereby forming a socket.

Furthermore, the present invention also includes a neutral wire contact plate which is disposed in the holding space. The neutral wire contact plate is provided with an elastic force enabling the neutral wire contact plate to move away from the neutral wire conductive member. The neutral wire conductive member and the neutral wire contact plate contact with each other by a second limiting element which is damaged at a temperature of 80° C.~299° C., allowing the neutral wire contact plate to be separated from the neutral wire conductive member by that elastic force. The size of the see-through region covers at a same time partial or whole part of the second limiting element, partial or whole part of the neutral wire conductive member and partial or whole part of the neutral wire contact plate, so that the user can be aware of whether the neutral wire conductive member and the neutral wire contact plate are limited by the second limiting element to maintain contacted, through the observation portion.

Furthermore, there are two observation portions.

Furthermore, the housing is made of a transparent material.

According to the abovementioned technical features, the benefits of the present invention include that:

1. When using the power connector having an observation portion according to the present invention, if a power outage occurs, then the user can determine immediately in visual whether the power outage is due to the overheat trip-off between the live wire conductive member and the live wire contact plate or the overheat trip-off between the neutral wire conductive member and the neutral wire contact plate which contact with each other under a normal condition.
2. For the plug or socket that includes the power connector having an observation portion, the user can check at any time whether the live wire conductive member and the live wire contact plate contact with each other normally that they can still be used safely or the neutral wire conductive member and the neutral wire contact plate contact with each other normally that they can still be used safely, through the observation portion.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

According to the abovementioned technical features, the primary benefits of the power connector having an observation portion can be clearly disclosed in the following embodiments.

Figure 1:
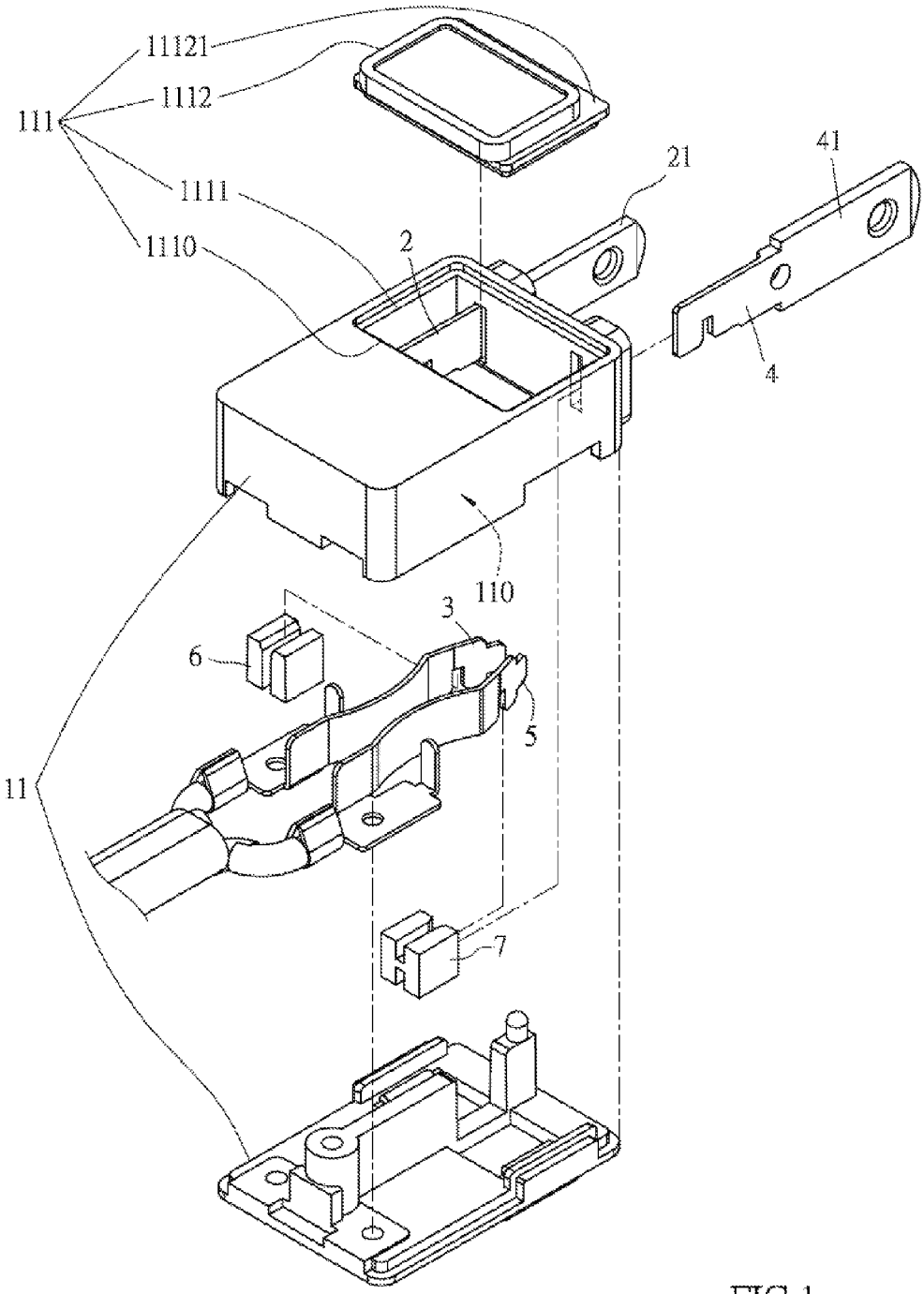
FIG. 1 shows a three-dimensional exploded view of an inner housing portion of a power connector having an observation portion which is a plug, according to a first embodiment of the present invention.
Figure 2:
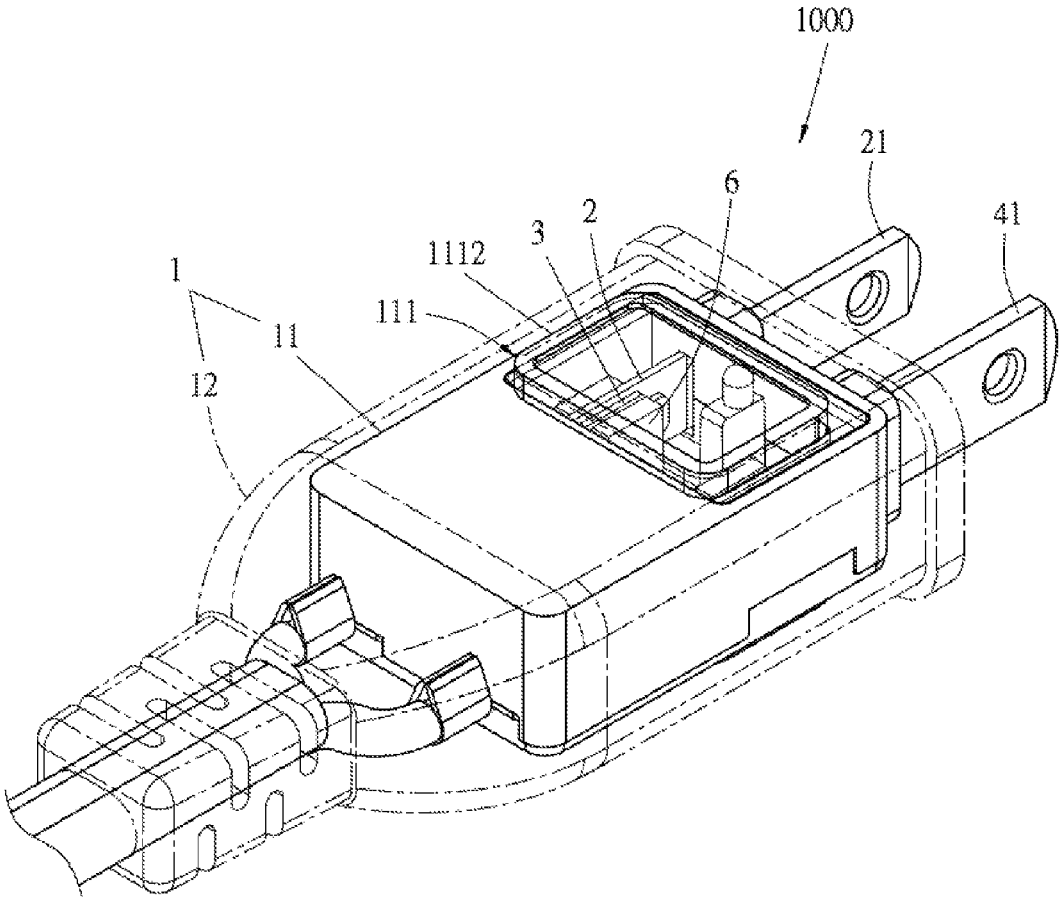
FIG. 2 shows a three-dimensional schematic view of appearance illustrating that the inner housing portion of the power connector having an observation portion, according to the first embodiment of the present invention, is formed in a shape of a plug after being enclosed by the outer housing portion.

Referring to FIG. 1 and FIG. 2, a power connector having an observation portion, according to a first embodiment of the present invention, is a plug 1000. The plug 1000 comprises a housing 1, a live wire conductive member 2, a live wire contact plate 3, a neutral wire conductive member 4 and a neutral wire contact plate 5. The housing 1 includes an inner housing portion 11 and an outer housing portion 12. The inner housing portion 11 is provided with a holding space 110 which accommodates the live wire conductive member 2, the live wire contact plate 3, the neutral wire conductive member 4 and the neutral wire contact plate 5. In addition, the live wire contact plate 3 is provided with an elastic force enabling the live wire contact plate 3 to move away from the live wire conductive member 2. The live wire conductive member 2 and the live wire contact plate 3 contact with each other by a first limiting element 6 which is damaged at a temperature of 80° C.~299° C., allowing the live wire contact plate 3 to be separated from the live wire conductive member 2 by that elastic force. The neutral wire contact plate 5 is provided with an elastic force enabling the neutral wire contact plate 5 to move away from the neutral wire conductive member 4. The neutral wire conductive member 4 and the neutral wire contact plate 5 contact with each other by a second limiting element 7 which is damaged at a temperature of 80° C.~299° C., allowing the neutral wire contact plate 5 to be separated from the neutral wire conductive member 4 by that elastic force.

Furthermore, the inner housing portion 11 is provided with an opening 1110 which connects the holding space 110 and corresponds to partial or whole part of the first limiting element 6, partial or whole part of the live wire conductive member 2, partial or whole part of the live wire contact plate 3, partial or whole part of the second limiting element 7, partial or whole part of the neutral wire conductive member 4 and partial or whole part of the neutral wire contact plate 5. A stair edge 1111 is disposed at the inner housing portion 11 in adjacent to the opening 1110. The inner housing portion 11 is also provided with a transparent shield 1112 corresponding to the opening 1110. The transparent shield 1112 is provided with a peripheral edge 11121 corresponding to the stair edge 1111, and covers the opening 1110 by abutting the peripheral edge 11121 at the stair edge 1111. The outer housing portion 12 is formed in a shape of a plug by glue molding and encloses the inner housing portion 11 to the peripheral edge 11121 of the transparent shield 1112, thereby fixing and exposing the transparent shield 1112. Accordingly, an observation portion 111 is formed, so as to constitute a see-through region from an exterior of the housing 1 through the observation portion 111, allowing a user to see through the holding space 110. The size of the see-through region covers simultaneously partial or whole part of the first limiting element 6, partial or whole part of the live wire conductive member 2, partial or whole part of the live wire contact plate 3, partial or whole part of the second limiting element 7, partial or whole part of the neutral wire conductive member 4 and partial or whole part of the neutral wire contact plate 5. Besides that, an end of the live wire conductive member 2 is protruded out of the housing 1, forming a live wire pin 21 of the plug 1000. An end of the neutral wire conductive member 4 is also protruded out of the housing 1, forming a neutral wire pin 41 of the plug 1000.

Figure 3:
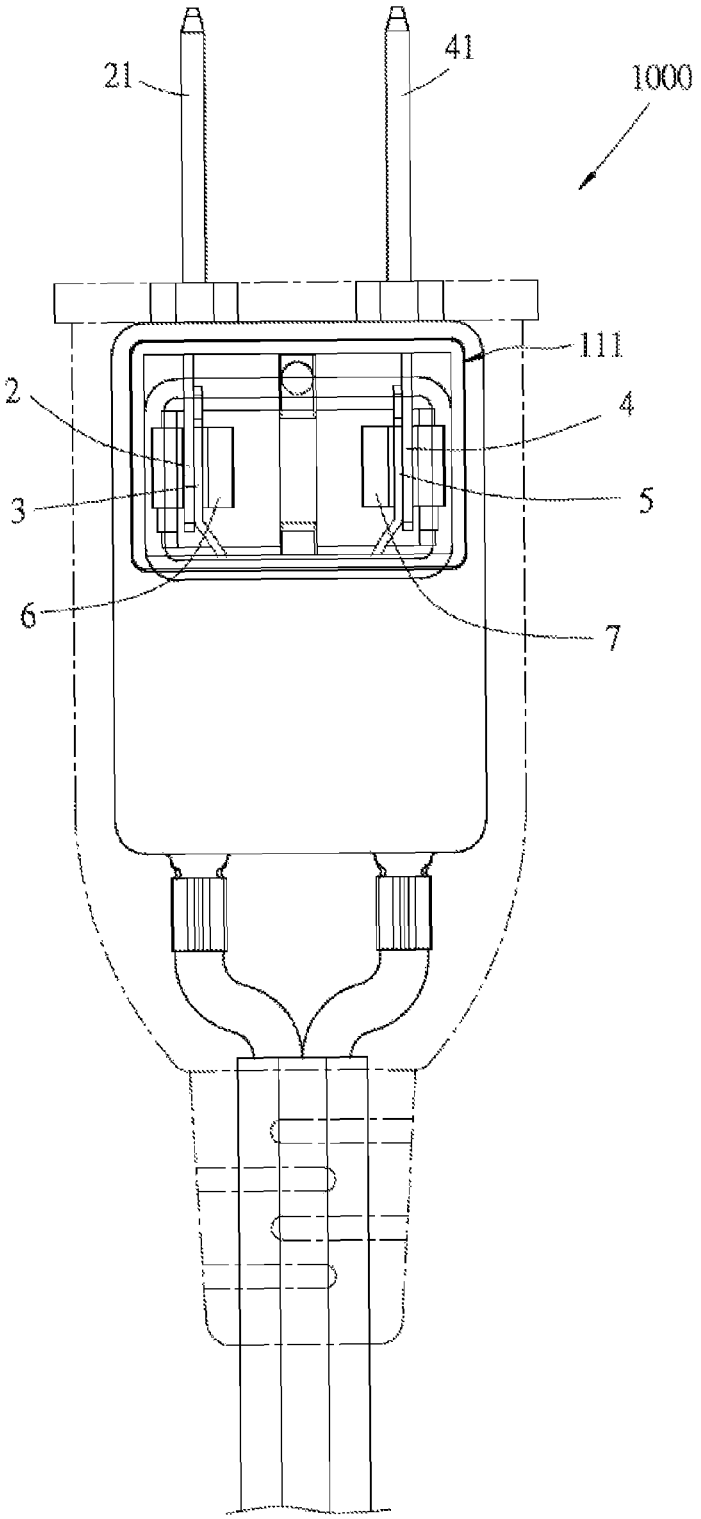
FIG. 3 shows a schematic view illustrating that when the power connector having an observation portion according to the first embodiment of the present invention is used, a user is aware of that the live wire conductive member and the live wire contact plate are limited by the first limiting element to remain contacted, and the neutral wire conductive member and the neutral wire contact plate are limited by the second limiting element to remain contacted, through the observation portion.
Figure 4:
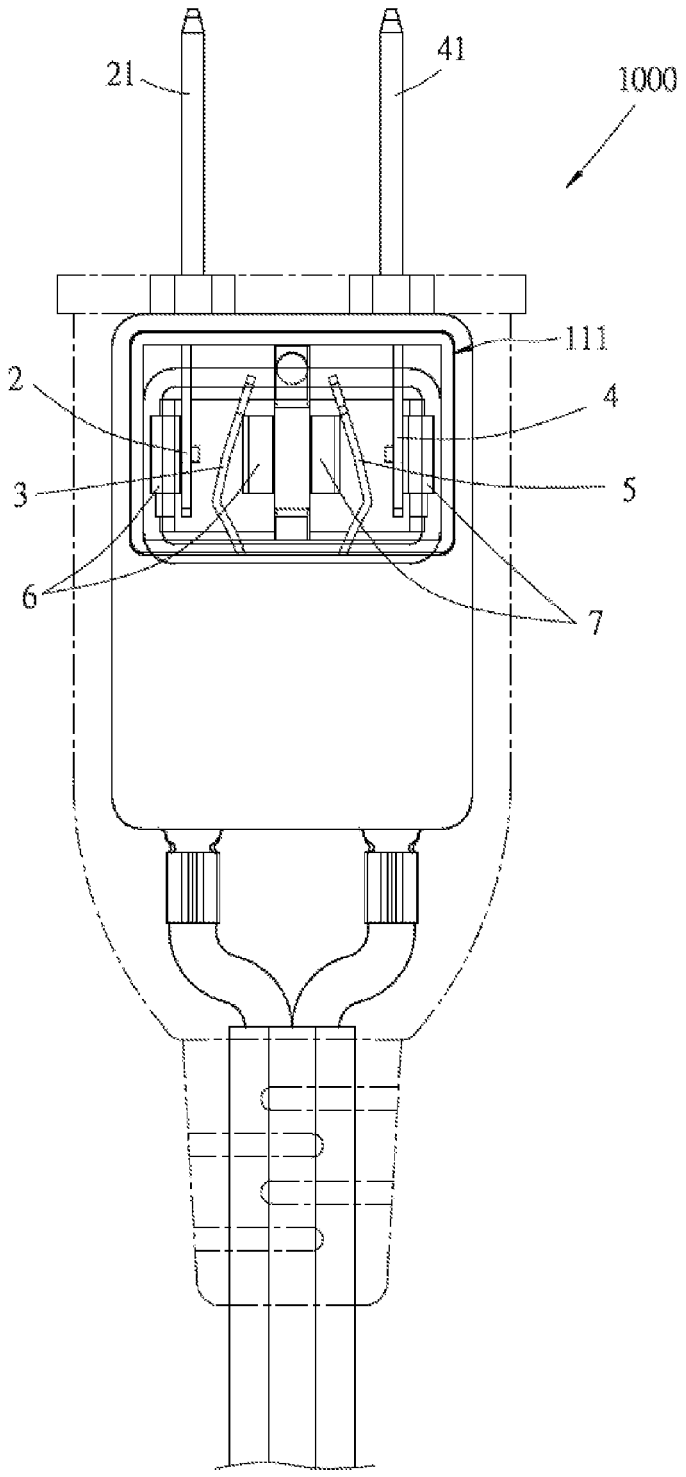
FIG. 4 shows a schematic view illustrating that when the power connector having an observation portion according to the first embodiment of the present invention is used, a user is aware of that the first limiting element and the second limiting element are damaged to prevent the live wire conductive member from contacting with the live wire contact plate, and the neutral wire conductive member from contacting with the neutral wire contact plate, through the observation portion.

Referring to FIG. 3 and FIG. 4, when a utilization device accesses electricity through the plug 1000 of the first embodiment, the live wire pin 21 is connected to a live wire of a supply end of electricity, and the neutral wire pin 41 is connected to a neutral wire of that supply end of electricity, allowing the live wire pin 21, the live wire conductive member 2, the live wire contact plate 3, the utilization device, the neutral wire contact plate 5, the neutral wire conductive member 4, the neutral wire pin 41 and the supply end of electricity to form a utilization loop. Therefore, when the utilization loop is in use, if there is abnormal utilization of electricity to overload the electric current on the utilization loop, or if the elastic force of the live wire contact plate 3 or the neutral wire contact plate 5 gets weaker, dust or a foreign object gets locked into the live wire contact plate 3 or the neutral wire contact plate 5, or the live wire contact plate 3 does not contact well with the neutral wire contact plate 5, then the contact place between the live wire conductive member 2 and the live wire contact plate 3 or the contact place between the neutral wire conductive member 4 and the neutral wire contact plate 5, of the first embodiment, will get overheated. When the temperature reaches 80° C.~299° C., or 150° C. in the present embodiment, the first limiting element 6 or the second limiting element 7 will be damaged, allowing the live wire conductive member 2 to be separated from the live wire contact plate 3 or the neutral wire conductive member 4 to be separated from the neutral wire contact plate 5, so as to power off the utilization loop compulsorily to avoid causing fire by an abnormally high temperature. At this time, as shown in FIG. 4, the user can easily observe that the first limiting element 6 or the second limiting element 7 is damaged, the live wire conductive member 2 does not contact or contacts badly with the live wire contact plate 3, or the neutral wire conductive member 4 does not contact with the neutral wire contact plate 5, through the observation portion 111. On the other hand, when electricity cannot be accessed, the user can observe through the observation portion 111 that the live wire conductive member 2 and the live wire contact plate 3 are limited by the first limiting element 6 to remain contacted, and the neutral wire conductive member 4 and the neutral wire contact plate 5 are limited by the second limiting element 7 to remain contacted, as shown in FIG. 3. Then, under this condition, it can be inferred that the utilization device may be malfunctioning.

On the other hand, in the first embodiment as shown in FIG. 1, when a power outage occurs, if only the second limiting element 7 in the plug is damaged that the neutral wire contact plate 5 is separated from the neutral wire conductive member 4, but the first limiting element 6 is not damaged that the live wire contact plate 3 and the live wire conductive member 2 still remain contacted, then although at this time the utilization loop has already been powered off, an internal wiring of the utilization loop will still keep being connected with the live wire of the supply end of electricity. In addition, if the utilization device itself is provided with the issue of electric leakage, and someone is standing on the ground to touch that utilization device, then as there is a voltage drop between the live wire of the supply end of electricity and the ground, an electric current will flow through the human body to result in an accident of getting an electric shock. Accordingly, whether a neutral wire end in a power connector is provided with a safety structure, the live wire end should be installed with a safety structure to exert the protection function.

Figure 5:
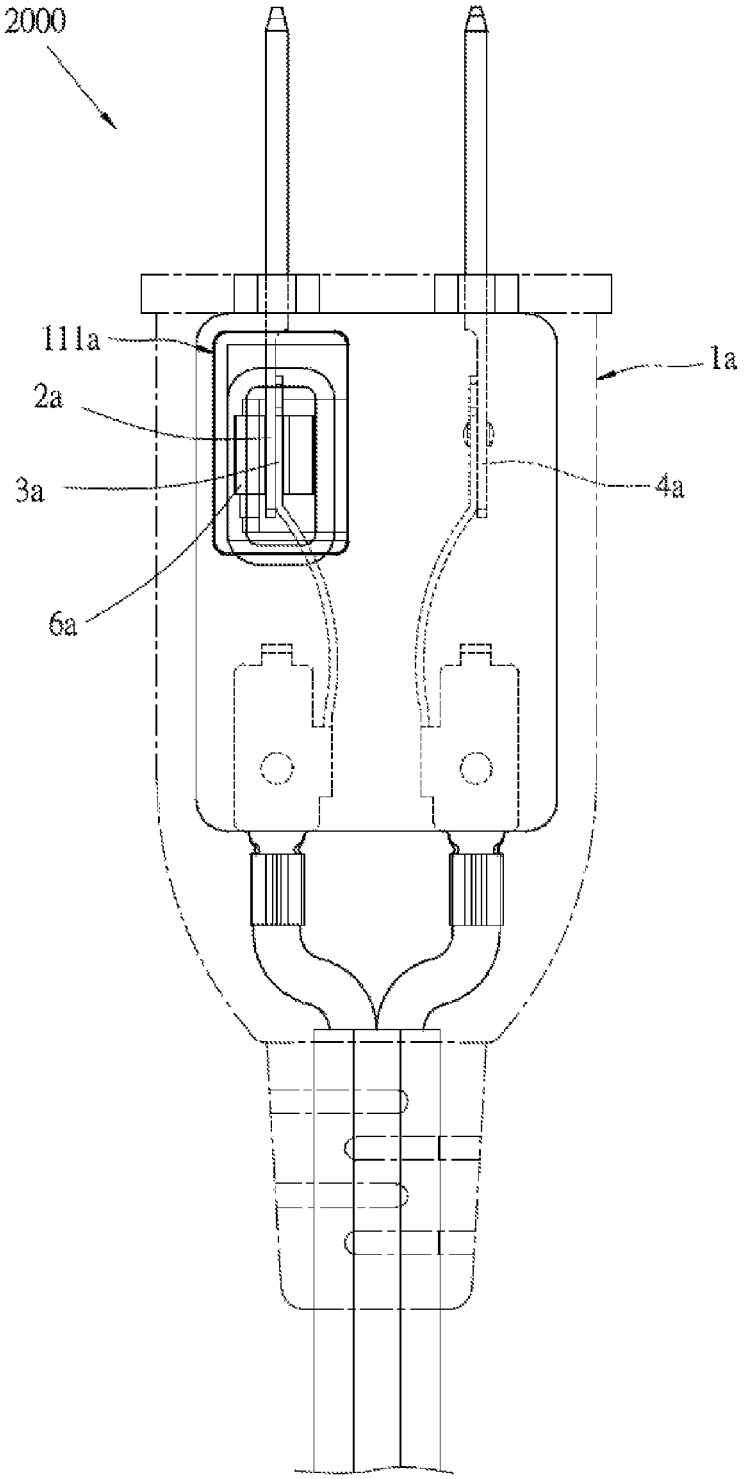
FIG. 5 shows a top view of the power connector having an observation portion, according to a second embodiment of the present invention.

Referring to FIG. 5, the power connector having an observation portion, according to a second embodiment of the present invention, is also a plug 2000. However, in the plug 2000, only a first overheating destructive limiting element 6*a* is disposed between the live wire conductive member 2*a* and the live wire contact plate 3*a*; whereas, the neutral wire conductive member 4*a* is directly fixed to a neutral wire of a utilization device. The observation portion 111*a* of the plug 2000 also forms a see-through region from an exterior of the housing 1*a*, allowing the user to see through the holding space defined by the housing 1*a*. The size of the see-through region only covers partial or whole part of the first limiting element 6*a*, partial or whole part of the live wire conductive member 2*a* and partial or whole part of the live wire contact plate 3*a*, so that the user can be aware of in visual whether the live wire conductive member 2*a* and the live wire contact plate 3*a* are limited by the first limiting element 6*a* to remain contacted, through the observation portion 111*a*.

Figure 6:
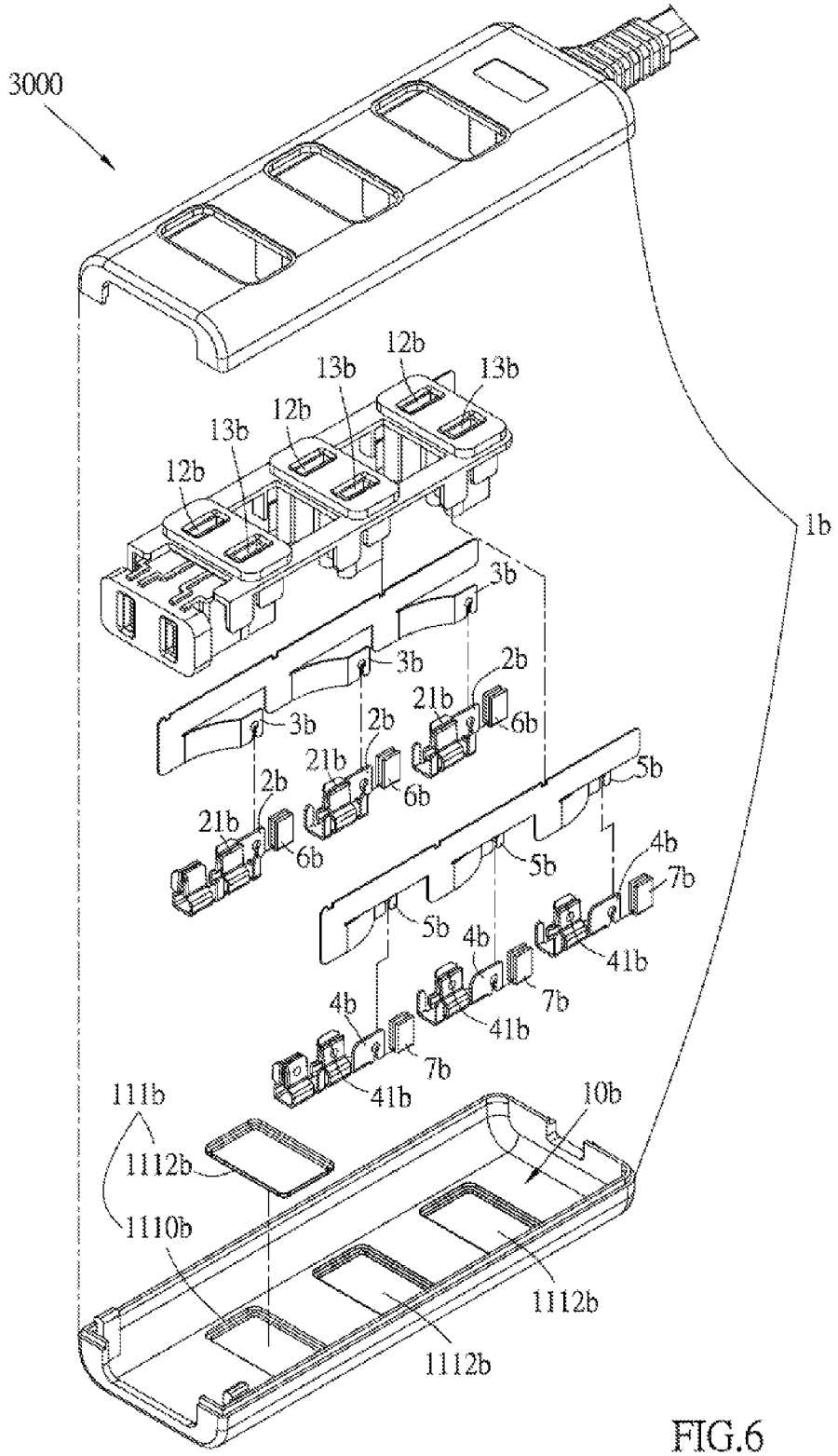
FIG. 6 shows a three-dimensional exploded view of the power connector having an observation portion which is an extension cord socket, according to the second embodiment of the present invention.
Figure 7:
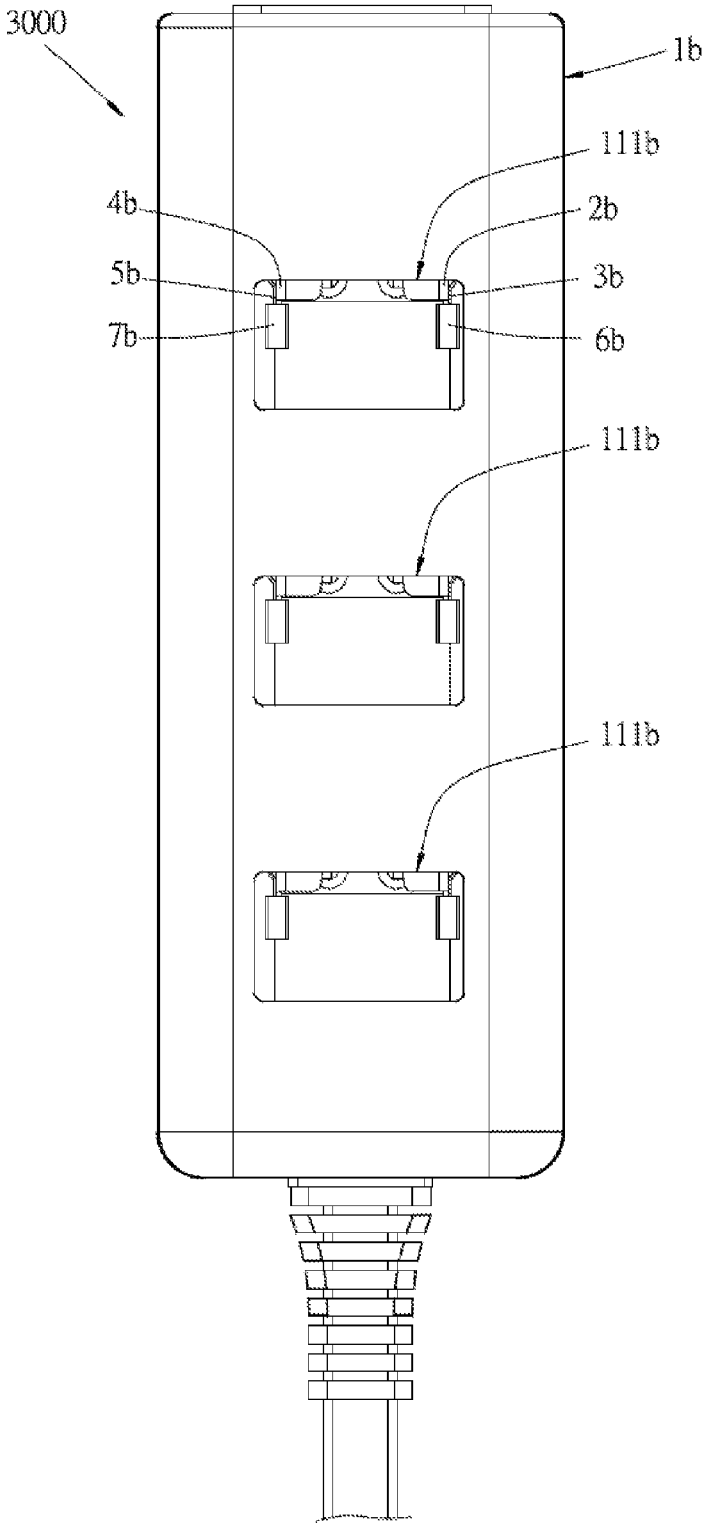
FIG. 7 shows a schematic view illustrating that the power connector having an observation portion is observed through the observation portion, according to the second embodiment of the present invention.

Referring to FIG. 6 and FIG. 7, it shows the power connector having an observation portion according to the second embodiment of the present invention. The second embodiment is an extension cord socket 3000 which is provided with about the same structure as that of the plug in the first embodiment, also comprising a housing 1*b*, a live wire conductive member 2*b*, a live wire contact plate 3*b*, a neutral wire conductive member 4*b*, a neutral wire contact plate 5*b*, a first limiting element 6*b*, a second limiting element 7*b*, and an observation portion 111*b* disposed in the housing 1*b*. The housing 1*b* defines a holding space 10*b* to accommodate the live wire conductive member 2*b*, the live wire contact plate 3*b*, the neutral wire conductive member 4*b* and the neutral wire contact plate 5*b*. The difference is that the live wire conductive member 2*b* is provided with a live wire slot 21*b* of the extension cord socket 3000, the neutral wire conductive member 4*b* is provided with a neutral wire slot 41*b* of the extension cord socket 3000, the housing 1*b* is provided with a live wire receptacle 12*b* of the extension cord socket 3000 corresponding to the live wire slot 21*b*, and a neutral wire receptacle 13*b* of the extension cord socket 3000 corresponding to the neutral wire slot 41*b*.

Referring to FIG. 7, the user is able to observe whether the live wire conductive member 2*b* and the live wire contact plate 3*b* are limited by the first limiting element 6*b* to remain contacted, and the neutral wire conductive member 4*b* and the neutral wire contact plate 5*b* are limited by the second limiting element 7*b* to remain contacted, through the observation portion 111*b*.

Furthermore, there can be two observation portions, with each one corresponding to partial or whole part of the first limiting element, partial or whole part of the live wire conductive member, partial or whole part of the live wire contact plate, partial or whole part of the second limiting element, partial or whole part of the neutral wire conductive member and partial or whole part of the neutral wire contact plate. On the other hand, the housing of the present invention can be also entirely made of a transparent material to have an observation portion in a larger area. The benefits of the abovementioned embodiments are described as examples to disclose the present invention and should not be used to limit the benefits of the present invention. In addition, the glue-molding enclosing structure for the housing in the abovementioned first embodiment is merely one kind of implementations of the plug, and should not be used to limit the housing of the present invention.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A power connector having an observation portion comprising:

a housing, a live wire conductive member, a live wire contact plate and a neutral wire conductive member, wherein the housing is provided with a holding space to accommodate the live wire conductive member, the live wire contact plate and the neutral wire conductive member, the live wire contact plate is configured to exert an elastic force enabling the live wire contact plate to move away from the live wire conductive member, and the live wire conductive member and the live wire contact plate contact with each other by a first limiting element which is damaged at a temperature of 80° C.~299° C., allowing the live wire contact plate to be separated from the live wire conductive member by that elastic force; the housing is provided with a transparent observation portion which forms a see-through region from an exterior of the housing, allowing a user to see through the holding space; and size of the see-through region covers simultaneously partial or whole part of the first limiting element, partial or whole part of the live wire conductive member and partial or whole part of the live wire contact plate, so that the user is aware of whether the live wire conductive member and the live wire contact plate are limited by the first limiting element to remain contacted through the observation portion.

2. The power connector having the observation portion according to claim 1, wherein the housing is provided with an opening which connects the holding space and contains partial or whole part of the first limiting element, partial or whole part of the live wire conductive member and partial or whole part of the live wire contact plate, the housing also includes a transparent shield to cover the opening, thereby forming the observation portion.

3. The power connector having the observation portion according to claim 2, wherein the housing includes an inner housing portion and an outer housing portion, the inner housing portion is provided with the holding space, the opening and the transparent shield; and the outer housing portion is formed by glue molding and encloses the inner housing portion to a peripheral edge of the transparent shield, thereby exposing the transparent shield.

4. The power connector having the observation portion according to claim 3, wherein a stair edge is disposed at the inner housing portion adjacent to the opening, whereas the peripheral edge abuts at the stair edge and is enclosed and fixed by the outer housing portion.

5. The power connector having the observation portion according to claim 1, wherein the live wire conductive member is provided with a live wire pin, the neutral wire conductive member is provided with a neutral wire pin, and the live wire pin and the neutral wire pin are all protruded out of the housing to form a plug.

6. The power connector having the observation portion according to claim 1, wherein the live wire conductive member is provided with a live wire slot, the neutral wire conductive member is provided with a neutral wire slot, the housing is provided with a live wire receptacle corresponding to the live wire slot, and a neutral wire receptacle corresponding to the neutral wire slot, thereby forming a socket.

7. The power connector having the observation portion according to claim 1, further comprising a neutral wire contact plate which is disposed in the holding space, wherein the neutral wire contact plate is configured to exert an elastic force enabling the neutral wire contact plate to move away from the neutral wire conductive member, the neutral wire conductive member and the neutral wire contact plate contact with each other by a second limiting element which is damaged at a temperature of 80° C.~299° C., allowing the neutral wire contact plate to be separated from the neutral wire conductive member by that elastic force; and the of the see-through area covers at simultaneously partial or whole part of the second limiting element, partial or whole part of the neutral wire conductive member and partial or whole part of the neutral wire contact plate, so that a user is aware of whether the neutral wire conductive member and the neutral wire contact plate are limited by the second limiting element to remain contacted through the observation portion.

8. The power connector having the observation portion according to claim 7, wherein there are two observation portions.

9. The power connector having the observation portion according to claim 1, wherein the housing is made of a transparent material.

* * * * *